US006289835B1

(12) United States Patent
Silberman

(10) Patent No.: US 6,289,835 B1
(45) Date of Patent: Sep. 18, 2001

(54) DEVICE FOR STORING FENDERS ON A BOAT

(76) Inventor: John Silberman, 5249 Loggerhead Pl., Fort Pierce, FL (US) 34949

( * ) Notice: Subject to any disclaimer, the term of this patent is extended or adjusted under 35 U.S.C. 154(b) by 0 days.

(21) Appl. No.: 09/559,670

(22) Filed: Apr. 28, 2000

(51) Int. Cl.[7] ..... B63B 59/02
(52) U.S. Cl. ..... 114/219
(58) Field of Search ..... 114/219, 220, 114/364, 343, 221 R, 190; 248/58, 339

(56) References Cited

U.S. PATENT DOCUMENTS 810,004 * 1/1906 Tabler ..... 114/219
1,769,015 * 7/1930 Carpenter ..... 248/58
3,215,385 * 11/1965 Rockland ..... 248/339
4,998,495 * 3/1991 Bos et al. ..... 114/218
5,848,770 * 12/1998 Oliver et al. ..... 248/58
5,957,416 * 9/1999 Sellati ..... 248/58

* cited by examiner

*Primary Examiner*—Stephen Avila
(74) *Attorney, Agent, or Firm*—Ronald E. Greigg; Edwin E. Greigg

(57) ABSTRACT

A boat fender storage device which includes a strip of metal radiused at each end to form first and second U-shape ends. The U-shaped ends have an opening which is sufficient to fit over a safety rail so that the boat fender can be secured to the safety rail by a pair of the boat fender storage devices.

8 Claims, 2 Drawing Sheets

DEVICE FOR STORING FENDERS ON A BOAT

This invention is directed to a storage device and more particularly a device for storing fenders for a boat when the fenders are not used for protection of a side of a boat.

PRIOR ART

Fenders for boats have been set forth in U.S. Pat. No. 4,998,495 which describes the desirability of protecting a side of a boat when the boat is tied up to some structure. To the extent of describing the use and advantages of a fender, the patent is incorporated herein by references.

Heretofore it has been well known to secure a boat fender to some part of the boat near the place of use and when not in use to just let the fender hang on an inside of the boat for dropping over the side when in use with one end of the fender secured to a line which is secured to a part of the boat.

Fenders have also been kept in wire baskets which hang from rails or in wire baskets which are secured to the deck. Such devices are usually in the way and take up deck space.

ADVANTAGE AND OBJECTS OF THE INVENTION

It is therefore an object of the invention to provide a fender hanger which is secured to a safety rail of a boat so that the fender will be out-of-the way from the deck.

Another object is to provide a device for storage of a fender in which the device can be adjusted for fenders of different lengths.

Still another object is to provide a device for storing a fender to a safety rail of a boat so that the fender is secured stationary and out-of-the-way.

Other objects and advantages of the invention will become obvious from the drawings and the following description.

DETAILED DESCRIPTION

Figure 1:
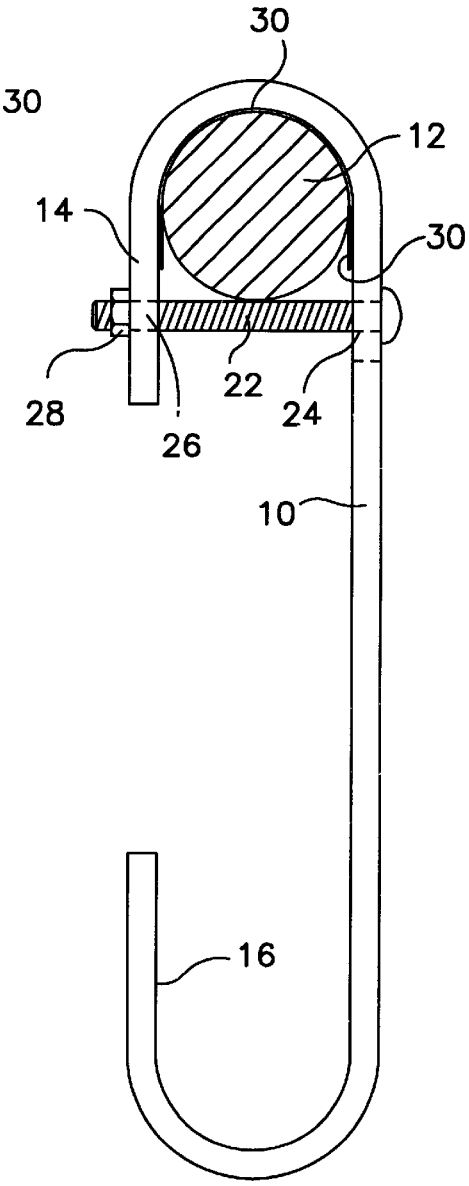
FIG. 1, illustrates a side view of a fender storage device.
Figure 4:
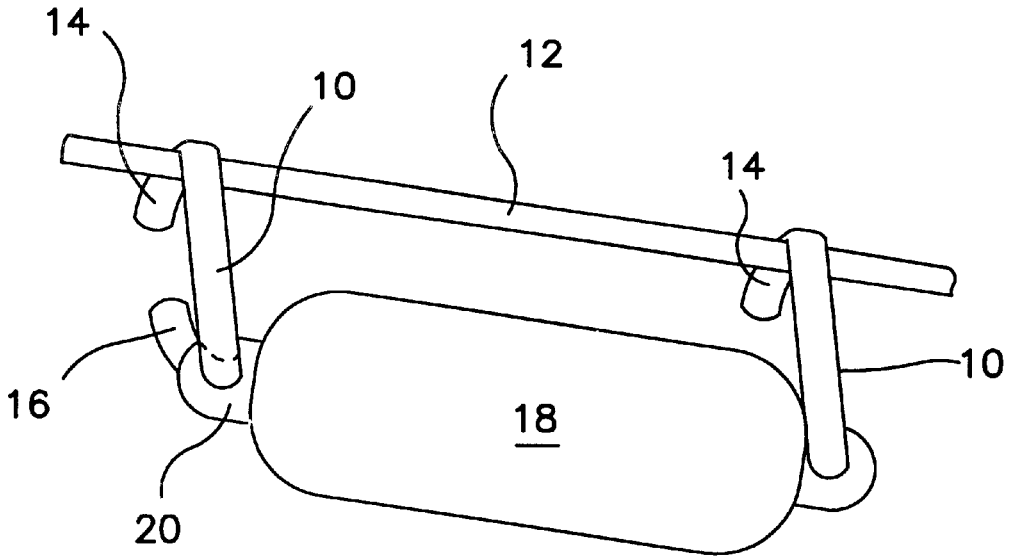
FIG. 4, illustrates a perspective view of a fender stored in the fender storage device.

Now referring to the drawings where each different reference refers to the same part throughout the drawings, there is shown in FIG. 1, a boat fender storage device (10) which is secured on a safety rail (12) shown as a solid rail. The fender storage device is shown with an upper U-shaped end (14) which fits over the safety rail. The lower end of the fender storage device is provided with a second U-shaped end (16) onto which one end of the fender is secured. As shown in FIG. 4, the fender (18) has eyelet ends (20) which fit over the lower U-shaped end of the fender storage devices. In order to store a fender, there must be a pair of spaced devices (10) which are spaced apart a length of the fender. Therefore two fender storage devices as shown in FIGS. 1 and 4 will be used, one storage device for each end (20) of the fender. The fender will be provided with eyelets

(20) on each end through which the lower U-shaped end of each fender storage device will pass to secure the fender in place. The upper end of the fender storage device is provided with a threaded bolt (22) which passes through oppositely disposed holes (24, 26). As shown, the bolt is secured in the holes by an appropriate nut (28). A piece of felt (30) is provided between an inner surface of the upper end of the fender storage device and the safety rail to which the fender storage device is secured. The felt can be glued or by some means secured to the under side of the upper U-shaped end. The nut on the bolt can be tightened sufficiently to prevent the fender storage device from rotating on the safety rail. It is suggested that the hook ends be turned outwardly for safety purposes.

Figure 2:
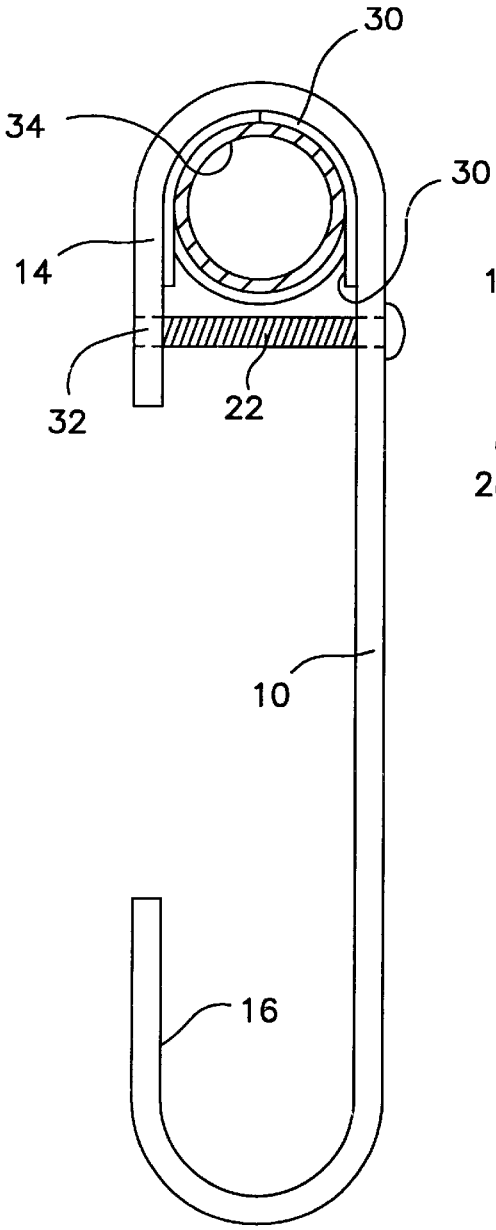
FIG. 2, illustrates a side view of a modification of the fender storage device of FIG. 1.

The modification shown in FIG. 2, is substantially the same as the fender storage device shown in FIG. 1. The only difference is, instead of a bolt and nut as shown in FIG. 1, one of the holes (32) formed in the upper end of the device is threaded so that the bolt is threaded into the threaded hole. It is suggested that the threaded hole be to the outside so that the treaded end of the bolt end extends through the threaded hole (32), the bolt will not create a safety hazard by extending from the fender storage device. In FIG. 2, the safety rail is shown as a tube (34).

Figure 3:
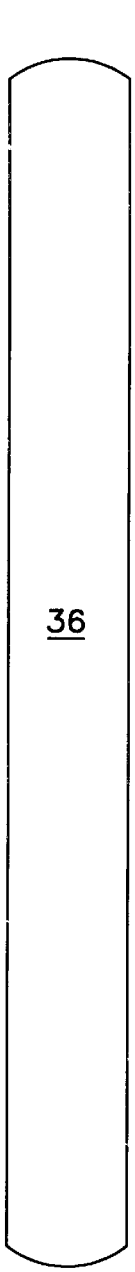
FIG. 3, is a width of a piece of material from which the fender storage device shown in FIGS. 1 and 2 can be made.

FIG. 3 illustrates a width of a strip of a metal bar (36) such as stainless steel from which the fender storage devices are formed. The thickness of the metal plate is shown in FIGS. 1 and 2.

As an example, the metal strip has a thickness of ⅛ inch, a width ⅝ inch, and a length of 13 inches. The upper and lower ends are radiused to loosely slip over the safety rail. Therefore the radiused ends depend on the size of the safety rod which are usually ⅞ inch or 1 inch. The upper and lower ends are turned 180 degrees so that the loose ends are parallel with the main portion. These measurements are only suggested and can be made to fit any sized rail with sufficient distance between the U-shaped ends to secure a boat protective fender.

FIG. 4 illustrates a boat protective fender (18) secured between two fender securing devices (10). As shown the eyelets in the boat protective fender slips onto the U-shaped bottom ends and the upper U-shaped ends are supported on the boat rail. Since the protective fender is supported below the safety rail, the protective fender is secured out-of-the-way and does not interfere with one walking within the boat. The fender can be stored near the position at which it will be used. Obviously a line can be secured to one end of the fender and secured to the fender storage device without interfering with the storage of the fender. When one is desirous of using the fender, the fender is removed from the fender storage device and placed alongside the boat with the line secured to a fitting in the boat. Any particular fender can be used so long as the fender has an eyelet or some other means for securing the fender to the fender storage devices.

Figure 5:
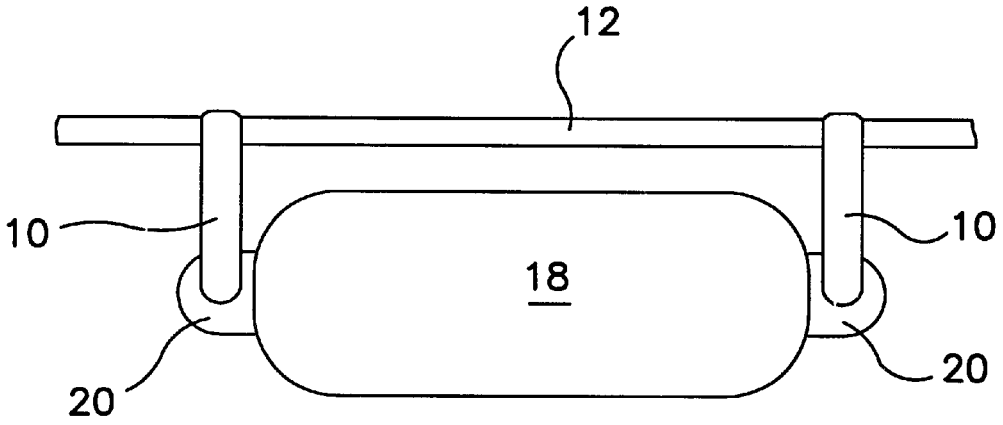
FIG. 5, is a side view of a fender secured to a safety rail by a pair of fender storage devices.

FIG. 5 is a side view of a fender held in a storage position by a pair of fender storage devices hooked over a safety rail.

The foregoing relates to a preferred exemplary embodiments of the invention, it being understood that other variants and embodiments thereof are possible within the spirit and scope of the invention, the latter being defined by the appended claims.

I claim:

1. A storage device for an elongated boat fender, said storage device including a holder at each end of said fender to which each end of said fender is connected, each holder consisting solely of:

an elongated body, said elongated body having a first radiused end bent to about 180 degrees to form a U-shaped end and a spaced second radiused end bent to about 180 degrees to form a second U-shaped end, said first and second radiused U-shaped ends being of similar sizes of approximately equal radius, and bent in the same direction with respect to the elongated body, each of said first and second radiused ends having a sufficient opening to fit over a safety rail of a boat.

2. A boat fender storage device as set forth in claim 1, wherein each holder further includes a strip of felt which is secured to the inside surface of the radiused end which fits over the safety rail.

3. A boat fender storage device as set forth in claim 2, wherein the radiused U-shaped end of each holder that fits over said safety rail, is further provided with apertures, with said apertures being placed in alignment with each other below said safety rail.

4. A boat fender storage device as set forth in claim 3, in which a bolt passes through said apertures and is secured in place by a nut.

5. A boat fender storage device as set forth in claim 3, in which one of said apertures is threaded, and another aperture is without threads, and a threaded bolt passes through the aperture without threads and is threaded into said threaded aperture.

6. A boat fender storage device as claimed in claim 3 which includes a pair of holders spaced along a safety rail of a boat with said first radiused U-shaped ends having said apertures fitted over said boat rail in which a fender is secured between said second radiused ends of said pair of storage devices.

7. A boat fender storage device as claimed in claim 6 in which said first radiused U-shaped end of said pair of holders is secured on said rail by a bolt passing through said aligned apertures.

8. A boat fender storage device as claimed in claim 6 in which one aperture of said aligned apertures of said first radiused U-shaped ends of said pair of holders is threaded and another of said aligned apertures is without threads such that a bolt passes through said aperture without threads and threads into said aperture including threads.

* * * * *